US010875735B2

(12) United States Patent
Leufstadius et al.

(10) Patent No.: US 10,875,735 B2
(45) Date of Patent: Dec. 29, 2020

(54) DEVICE AND METHOD FOR AUTOMATIC SPLICING

(71) Applicant: Tetra Laval Holdings & Finance S.A., Pully (CH)

(72) Inventors: Emanuel Leufstadius, Malmö (SE); Alexander Persson, Lund (SE)

(73) Assignee: Tetra Laval Holdings & Finance S.A, Pully (CH)

( * ) Notice: Subject to any disclaimer, the term of this patent is extended or adjusted under 35 U.S.C. 154(b) by 65 days.

(21) Appl. No.: 16/322,910

(22) PCT Filed: Jul. 12, 2017

(86) PCT No.: PCT/EP2017/067520
§ 371 (c)(1),
(2) Date: Feb. 1, 2019

(87) PCT Pub. No.: WO2018/024454
PCT Pub. Date: Feb. 8, 2018

(65) Prior Publication Data

US 2019/0168981 A1 Jun. 6, 2019

(30) Foreign Application Priority Data

Aug. 3, 2016 (EP) ..... 16182641

(51) Int. Cl.
*B65H 21/02* (2006.01)

(52) U.S. Cl.
CPC ..... *B65H 21/02* (2013.01); *B65H 2301/4606* (2013.01); *B65H 2301/46013* (2013.01);
(Continued)

(58) Field of Classification Search
CPC ..... B65H 21/02; B65H 2301/46013; B65H 2301/46115; B65H 2301/460183;
(Continued)

(56) References Cited

U.S. PATENT DOCUMENTS

2005/0167053 A1 8/2005 Matthias et al.

FOREIGN PATENT DOCUMENTS

WO WO 2015/173122 A1 11/2015

OTHER PUBLICATIONS

Search Report and Written Opinion received in International Application No. PCT/EP2017/067520 dated Feb. 8, 2019.

*Primary Examiner* — Sang K Kim
(74) *Attorney, Agent, or Firm* — Knobbe, Martens, Olson & Bear, LLP

(57) ABSTRACT

A method for splicing a web of packaging material is provided. The method involves guiding a first web of packaging material through an automatic splicing device, determining the position of at least one mark of the first web of packaging material by a detector, moving the first web of packaging material based on the position of the at least one mark of the first web of packaging material such that a specific area of the first web of packaging material is arranged in proximity to a cutting unit, and cutting the first web of packaging material in order to form a separate leading part of the first web of packaging material. The method may also involve introducing a new leading part of a second web of packaging material into the automatic splicing device, determining the position of at least one mark of the second web of packaging material, moving the second web of packaging material based on the position of the at least one mark of the second web of packaging material such that a specific area of the second web of packaging material is arranged in proximity to a sealing arm of the cutting unit, and sealing the separate leading part of the first web of packaging material and the second web of packaging material.

14 Claims, 14 Drawing Sheets

(52) U.S. Cl.
CPC ..... *B65H 2301/46015* (2013.01); *B65H 2301/46022* (2013.01); *B65H 2301/4695* (2013.01); *B65H 2301/46115* (2013.01); *B65H 2301/46172* (2013.01); *B65H 2301/460183* (2013.01); *B65H 2511/214* (2013.01); *B65H 2553/42* (2013.01); *B65H 2701/1241* (2013.01); *B65H 2701/1944* (2013.01)

(58) Field of Classification Search
CPC .... B65H 2301/4606; B65H 2301/4695; B65H 2701/1241
See application file for complete search history.

DEVICE AND METHOD FOR AUTOMATIC SPLICING

TECHNICAL FIELD

The present disclosure relates to a device and a method for automatically combining the ends of two webs of packaging material, referred to as splicing of packaging material

BACKGROUND

Packaging material, in particular packaging laminate comprising a core of fibrous material, such as paper board or carton board is manufactured in sequential steps. The order of the steps, as well as the contents of a particular step may vary, yet as an example the process may start with the production of the board.

The board is produced in a paper mill and rolled onto large-sized rolls and shipped to a converting facility. In the converting facility the large-size rolls are unrolled and additional layers, usually plastics and or aluminium foil, is extruded (or laminated) onto the surfaces of the board, and rolled onto a new roll. In the same, or in a previous or a subsequent the web of material may also be provided with a suitable decor and crease lines, i.e. weakening lines providing guides when a subsequent packaging container is to be folded.

At some step during the process the first large-size roll is divided into multiple rolls in a width direction. The resulting rolls may typically have a width corresponding to a crease pattern in a first direction for a single packaging container and a length corresponding to the crease patterns in a second direction for a specific number of packaging containers. The specific number is typically in the order to thousands of packaging containers, but there is obviously a maximum amount of packaging containers that could be fitted onto a single roll.

Splicing of the web can be applied in many different steps of the manufacture of roll of packaging material, i.e. splicing can be performed on full-width webs in the converting facility, or of single package-width webs after cutting of the full-width webs. Typical examples are when an additional length of packaging material has to be added to an existing roll, and when a portion of the web has been removed since it contains a defect. The latter is often referred to as "doctoring".

Packs for liquid foods, for example juices or milk, are known, comprising plastic-coated paper, cardboard or generally a coated fibre layer. During production of the packaging material a web material is arranged on a roll. Thus the individual rolls comprise a wound material web which is previously embossed, stamped, laminated and so forth. When the individual roll is exhausted, either during converting or during operation of a subsequent filling machine, a reserve roll must be in readiness in good time and the trailing edge of the 'old' material web of the exhausted individual roll must be joined to the pre-prepared leading edge of the new individual roll. That method of joining the two material webs is also referred to as 'splicing'.

EP1184311 discloses a method of providing one of the two transverse edges of the material webs with an inclined cut and then, with the acutely terminating edge of the material web being bent over, glueing it in such a way that a liquid-tight weld is provided on the product side. In that way the originally open surface of the fibre layer is covered by plastic material and liquid-tightly welded.

Automatic splicing of material webs is associated with a number of problems. Gluing the trailing edge of a material web roll to the leading transverse edge of the reserve material web roll requires pressure and heat to be applied in the correct amount and at the right time to the complete width of the transverse edge of a material web in such a way to produce an adhesive join of good quality and with good liquid-tight sealing integrity.

Further, correct positioning of the leading transverse edge of the reserve material web is of outmost importance, both in terms of longitudinal, transverse, and angular alignment.

Using the above as a starting point there are still improvements to be made, especially for automatic splicing of full-width material webs having a width of typically 1.6 m. In that context it should be stated that any improvement in the area of splicing and similar operations may have a direct impact on the time spent on the operation, on the quality of the result on the amount of waste generated in downstream processes etc.

The present disclosure aims at providing a new method and device for automatic splicing that can be implemented for full-width material webs, having the purpose of providing a high consistent performance and increased efficiency.

SUMMARY

To that end the present disclosure may be said to, according to a first aspect thereof, relate to a method for splicing a web of packaging material. The method comprises guiding the web of packaging material through an automatic splicing device; determining the position of at least one mark of the material web by means of a detector; moving the material web based on the determined position such that a specific area of the material web is arranged in proximity to a cutting unit; and cutting the material web in order to form a separate leading part of the material web. The method also comprises introducing a new leading part of a separate material web into the automatic splicing device; determining the position of at least one mark of the newly introduced material web; moving the newly introduced material web based on the determined position such that a specific area of the newly introduced material web is arranged in proximity to a sealing arm of the cutting unit; and sealing the separate leading part of the material web and the newly introduced material web.

According to an embodiment, determining the position of the marks is performed using a detector in the form of an imaging device and associated image analysis.

The method may further comprise cutting the newly introduced material web prior to moving the newly introduced material web based on the determined position such that a specific area of the newly introduced material web is arranged in proximity to a sealing arm of the cutting unit.

The position of the cutting unit may be fixed during the entire splicing operation.

Cutting the material web and cutting the newly introduced material web may preferably be performed at an angle relative the cross-wise direction of the material web.

In an embodiment, the method further comprises moving the leading part of the material web longitudinally to a sealing position prior to introducing a new leading part of a separate material web into the automatic splicing device.

According to a second aspect, an automatic splicing device for web material is provided. The device comprises a cutting unit configured to cut and seal the web material, a web feeding arm configured to move the web material, at least one detector, and a control unit. The control unit is configured to determine the position of at least one mark of an initial material web, controlling the web feeding arm based on the determined position such that a specific area of the initial material web is arranged in proximity to the cutting unit, determine the position of at least one mark of a newly introduced material web, controlling the web feeding arm based on the determined position of the mark of the newly introduced material web such that a specific area of the newly introduced material web is arranged in proximity to the cutting unit, and controlling sealing of the initial material web to the newly introduced material web.

The web feeding arm may extend across the width of the material web.

In an embodiment the web feeding arm is configured to be tilted relative a longitudinal direction of the material web in use.

The cutting unit may comprise a cutting arm and a sealing arm, and the cutting arm and the sealing arm may be mounted on a fixed frame.

In an embodiment the cutting arm and the sealing arm are tiltable relative a longitudinal direction of the material web in use.

The cutting arm and the sealing arm may extend across the width of the material web.

The cutting arm may in some embodiments be arranged at a longitudinal distance from said sealing arm.

Further embodiments are disclosed in the detailed description and it should be emphasized that features of all embodiments may be freely combined to accomplish further advantages, i.e. the embodiments are provided by means of examples, not with the intent to provide an exhaustive list of all alternatives available within the scope of the appended claims.

DETAILED DESCRIPTION

Figure 1A:
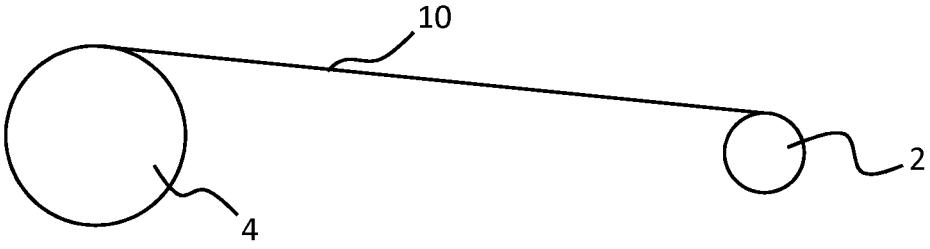
FIG. 1*a* is a very schematic side view of a rudimentary system for handling a web of packaging material.
Figure 1B:
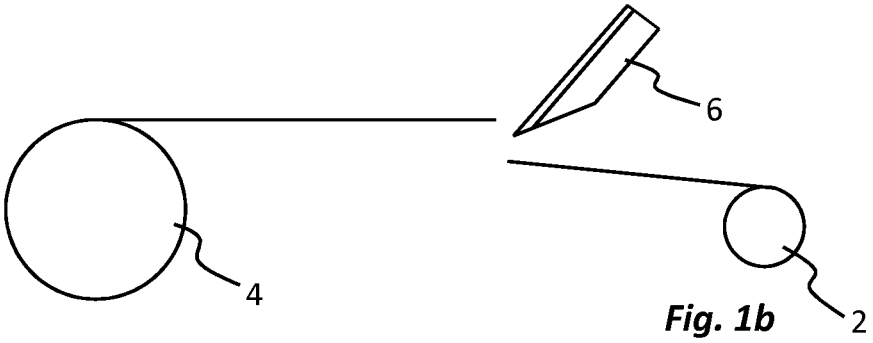
FIG. 1*b* is a side view of the system shown in FIG. 1*a* during a cutting step of an automatic splicing method according to an embodiment.
Figure 1C:
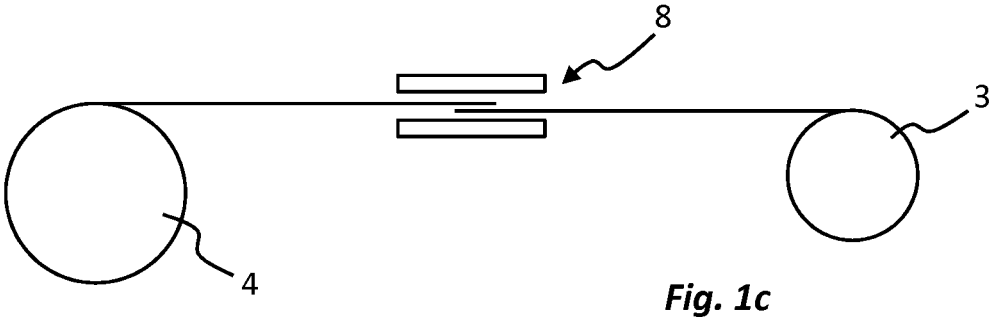
FIG. 1*c* is a side view of the system shown in FIGS. 1*a-b* in a sealing step of the automatic splicing method.

FIGS. 1*a-c* illustrate in ultimate simplicity the setup of an automatic splicing operation of the present disclosure. What is shown is a web 10 of packaging material being wound from a first reel 2 to a second reel 4. Between the first and the second reel the web 10 may pass over and under a number of rollers and guides (not shown). Furthermore, at least one cutting and sealing device 6, 8 (see FIG. 1*b-c*) is arranged along the path of the packaging material web 10. The cutting and sealing device 6, 8, shown schematically in FIG. 1*b-c*, forms part of an automatic splicing device which will be later described in more detail with reference to FIGS. 4-14.

When the supply reel 2 is almost exhausted the material web is cut transversely as is shown in FIG. 1*b*. A leading end of a web unwound from a new, second reel 3 is superimposed on the trailing end of the web of the first reel 4 as is shown in FIG. l*c*. As is further indicated in FIG. 1*c* the leading end of the web from the second reel 3 is then spliced to the trailing end of the web of the first reel 4 so that material web handling can be continued without interruption.

The sealing may e.g. be performed by using a combination of heat and pressure during a preset period of time. In one or more embodiments the heat is applied from the side of the packaging material that subsequently will be directed towards the interior of a packaging container formed from the packaging material; it should however be realized that heating may be done in various sways and from various directions as long as the desired effect is accomplished.

The sealing unit, in particular a sealing bar providing the heat and pressure may be pneumatically controlled, hydraulically controlled or spring biased so that a well defined force is applied onto the area to be joined.

Tail and head are used to describe the ends to be fused, namely the trailing end of the first web of packaging material and the leading end of the second web of packaging material respectively.

It should be realized that the general description presented above could be easily modified to operate for doctoring purposes. In such cases the second reel 3 of FIG. 1*c* is replaced by the original second reel 2 of FIG. 1*a-b*, whereby two transversal cuts of the material web 10 are performed to remove an unwanted piece of the material web 10. Hence the first web of packaging material and the second web of packaging material may be the same web of packaging material having been cut in a doctoring operation where a defect segment has been removed.

Figure 2:
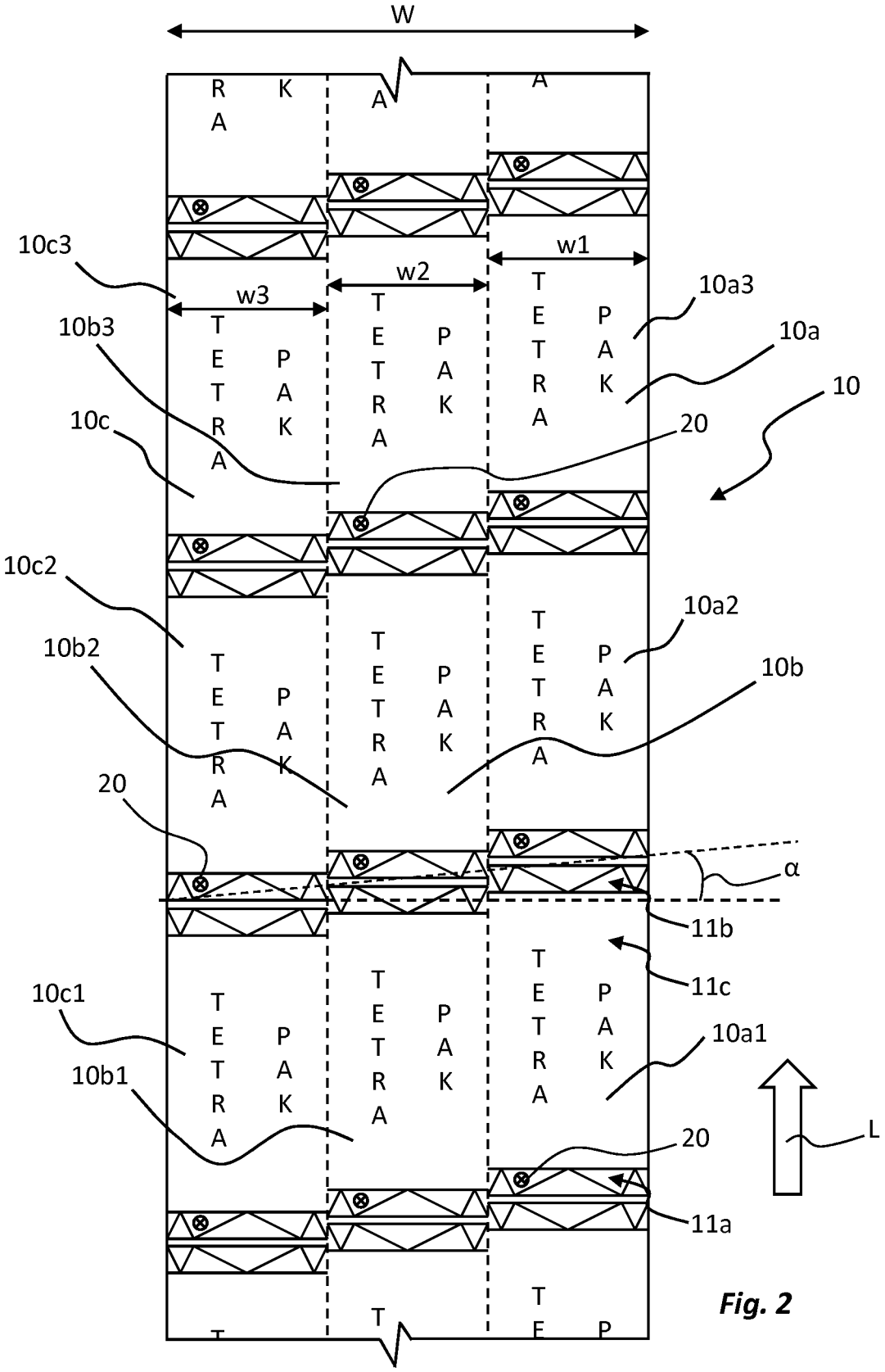
FIG. 2 is a top view of a web of packaging material for use in a splicing method according to various embodiments.

For facilitating the understanding of the automatic splicing device to be described later, some general description of a web of packaging material will be given with reference to FIG. 2. The web of packaging material 10 is assumed to be fed in a longitudinal direction L, indicated by the arrow on FIG. 2. Further, as can be seen in FIG. 2 the web 10 of packaging material is a full-width web, later to be cut into a plurality of individual webs 10*a*, 10*b*, 10*c*. Each individual web 10*a-c* is then to be fed to a filling machine, wherein carton-based packages are produced from the web 10*a-c* and filled with content. Although the web 10 includes three parallel transversal sections 10*a-c* for later forming the individual webs 10*a-c* it should be realized that other number of transversal sections 10*a-c* could of course be realized.

Typically, the web 10 has a width W of approximately 1.6 m. Each transversal section 10*a-c* has a width w1-3 such that W=w1+w2+w3. The transversal section widths w1-3 may not necessarily be equal.

Each transversal section 10*a-c* is processed such that individual packages may be formed from it. Hence, each transversal section 10*a-c* comprises a vast amount of longitudinal sections 10*a*1, 10*a*2, 10*a*3, 10*b*1, 10*b*2, 10*b*3, 10*c*1, 10*c*2, 10*c*3. Typically, each transversal section 10*a-c* includes several thousands of consecutive longitudinal sections.

Each longitudinal section 10*a*1-10*c*3 is configured to form an individual package. With reference to longitudinal section 10*a*1 each longitudinal section has a lower area 11*a* provided with crease lines to form a bottom end of the final package, an upper area 11*b* provided with crease lines to form an upper end of the final package, and a centre area 11*c* to form the longitudinal body of the final package.

At least one mark 20 is preferably provided somewhere at each longitudinal section 10*a*1-10*c*3. The at least one mark 20 may e.g. be a visual mark, or an embedded mark e.g. including magnetic particles which may be detected by associated magnetic sensor circuitry, or combinations thereof. In case of a magnetic embedded mark it should be realized that such mark may be detected optically, as the magnetic particles will provide contrast relative the surrounding packaging material. Preferably the position of the at least one mark 20 is well-defined, e.g. with reference to the lateral edge of the web 10, the longitudinal distance to the end of the associated or adjacent crease line area 11*a*, 11*b*, etc.

As can be seen in FIG. 2 the transversal sections 10*a*-*c* are staggered relative each other by an angle α. The reasons for such staggered configuration may vary, but in some cases it may be advantageous to avoid periodic vibrations in the creasing rollers, i.e. the rollers being provided with crease line patterns, which may occur if the crease lines are arranged on a common transversal area.

Some general comments on crease lines will now be presented. Crease lines are folding indications pressed into the packaging material, and when the packaging material is intended for the formation of packaging containers a pattern of crease lines will be "printed" onto the packaging material. Looking at a packaging container the majority of crease lines are located in the area from which the bottom and top of the packaging container is to be formed, i.e. areas 11*a*-*b*, and therefore the transversal splicing cut will be made in an area corresponding to the main body 11*c* of the packaging container. The exact position is not that crucial and the method may be applied to material not having any crease lines. The dynamics and use of crease line is an area of research itself, and for the purposes of the present disclosure the skilled person will have enough knowledge even without the above short explanation. There is one additional reason for making the splicing cut somewhere between the top and bottom of the packaging container to be formed. That reason relates to that a package being formed from a section of packaging material comprising a splice is usually discarded. By having the cut in the middle of the container it is ensured that only one single packaging container is affected by the splice and thus only one packaging container is discarded. This fact may raise the question as of why the performance of the splice is so important if the resulting packaging container is discarded anyway. One answer is that the package is not discarded before it has been filled since that is the way most filling systems operate. Any leakage or other malfunction before will therefore cause significant problems, and for that reason the splice need to be intact, and able to withstand liquid pressure.

The suitable position for the splicing cut may in one or more embodiments correspond to an area where the splicing cut will intersect a minimum amount of crease lines, and the splicing cut angle relative the transversal direction of the web 10 may thus be equal to, or close to, the staggering angle α.

Figure 3:
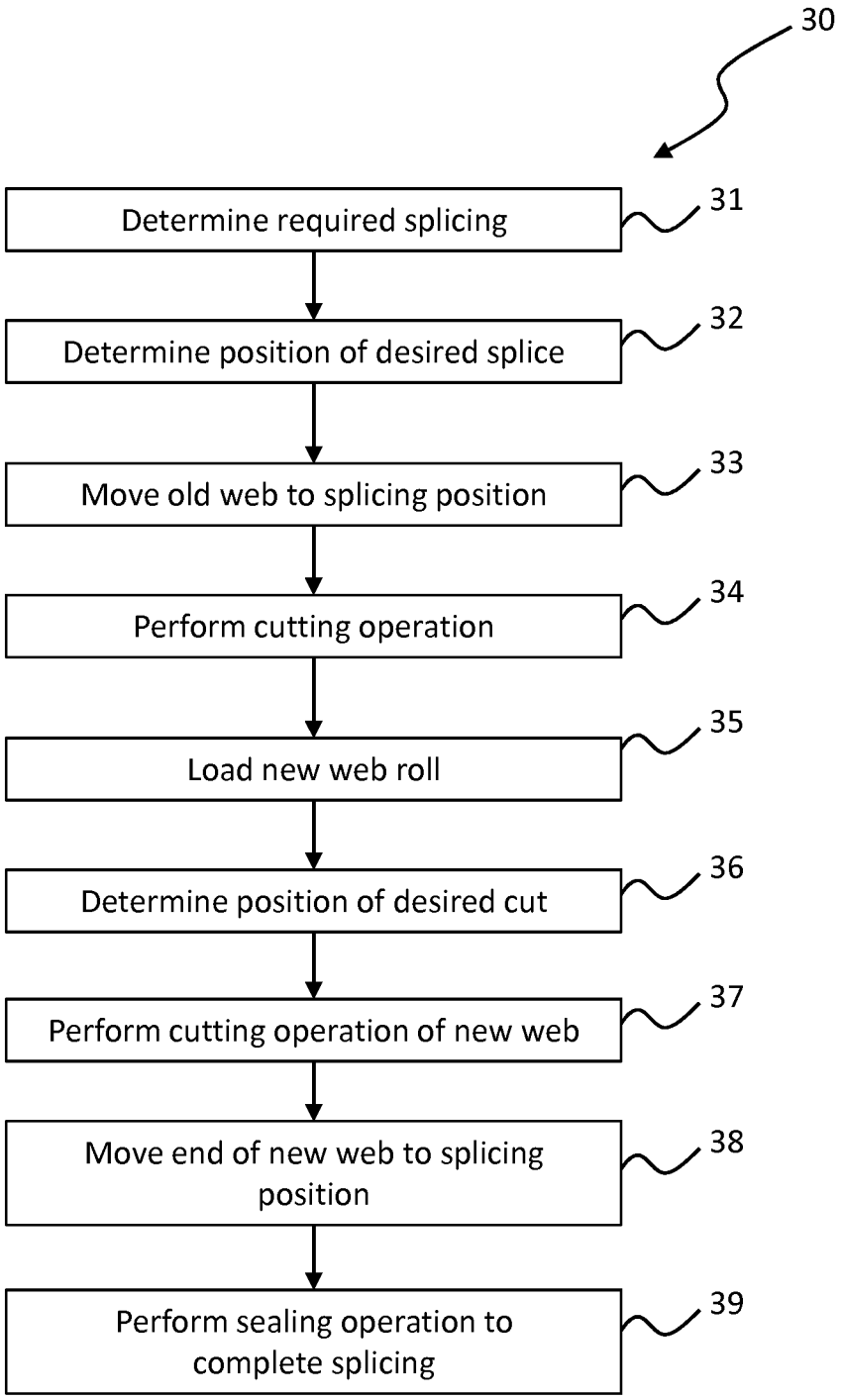
FIG. 3 is a schematic view of a splicing method according to an embodiment.

Now turning to FIG. 3 an embodiment of a method 30 for automatically splicing a web of material will be described. Initially, in step 31, it is determined that splicing is required. The reason for this decision may e.g. be that a supply roll is about to run empty, or that doctoring is needed. Thereafter, in step 32, the exact position of the desired splicing is determined. This may e.g. be performed by detecting the position of one or more marks 20 within a specific area of the web 10, and to calculate a suitable splicing position based on this current position. In a following step 33 the web 10 of material is fed forward so that the calculated splicing position of the web 10 is arranged in the cutting area of an associated cutting unit. The cutting unit performs the cutting operation, preferably at the staggering angle a, in step 34. The trailing end of the cut web 10 is locked in position, and in the case where the old supply roll was running empty the old roll is replaced by a new supply roll.

In a subsequent step 35 a new web roll is mounted to the automatic splicing device, and in step 36 the exact position of the desired cut of the leading end of the new web 10 is determined. It should however be realized that in case of doctoring, i.e. when the same web roll is to be used, step 35 is omitted and step 36 is performed for the same web roll. The exact position of the desired cut is in such embodiment determined by detecting the defect area, and setting the position of the desired cut beyond the defect area.

Step 36 of determining the exact position of the desired cut may e.g. be performed by detecting the current position of one or more marks 20 within a specific area of the new web 10, and to calculate a suitable cutting position based on this current position.

In step 37 the web is cut at the desired position, optionally this step is preceded by a step of moving the new web in forward and or cross direction until the desired cutting position is located in the area of the cutting unit.

In step 38 the leading end of the new web is moved by a forward movement until it reaches the splicing position, i.e. the same position as where the trailing end of the old web is locked. When arranged in this position, splicing is accomplished by sealing the trailing end of the old web to the leading end of the new web.

Figure 4:
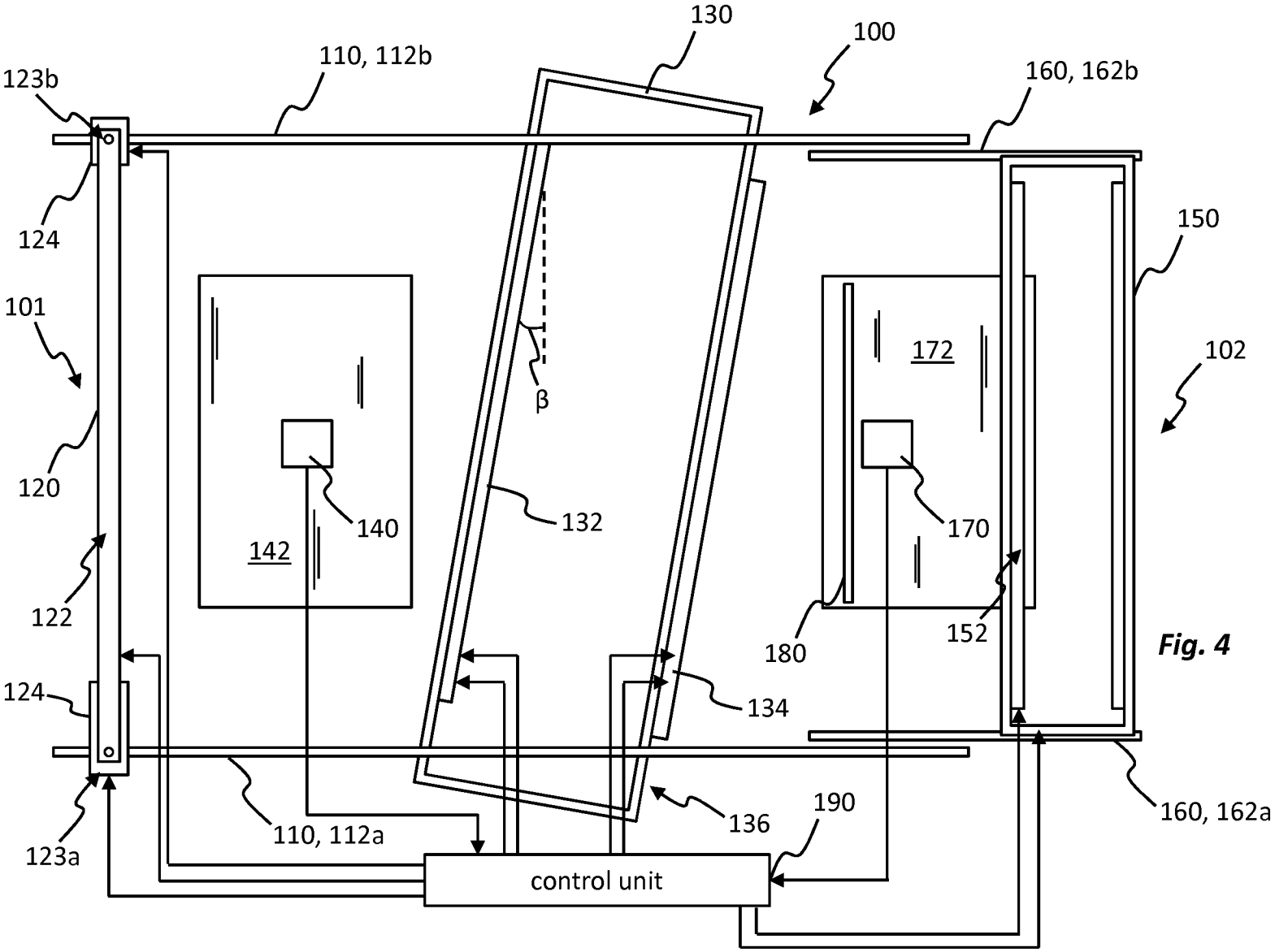
FIG. 4 is a top view of an automatic splicing device according to an embodiment.

All the above mentioned steps can be performed automatically by an automatic splicing device 100 as shown schematically in FIG. 4. The automatic splicing device 100 extends in the longitudinal direction of an associated material web between an input end 101 and an output end 102. The automatic splicing device 100 comprises a web feeding frame 110 along which a web feeding arm 120 is movably supported. Hence, the web feeding arm 120 can change its longitudinal position relative the web feeding frame 110.

The web feeding arm 120 is configured to move a leading end of the material web in the longitudinal direction, and for this purpose the web feeding arm 120 is provided with means 122 for securing the material web to the web feeding arm 120. Such securing means 122 may e.g. include vacuum suction nozzles distributed along the cross-wise extension of the web feeding arm 120, adhesives, or similar. Preferably the securing means 122 is controllable such that securing of the material web could be activated and deactivated, respectively.

The web feeding arm 120 is supported by the web feeding frame 110 preferably at its respective ends 123*a*, 123*b*. For this the web feeding frame 110 comprises two parallel beams 112*a*, 112*b*, onto which supports 124 of the web feeding arm 120 may slide or move. The supports 124 may have drivers (not shown), such as linear motors for achieving a desired movement longitudinally along the web feeding frame 110.

The drivers of the supports 124 of the web feeding arm 120 are preferably individually controlled such that one support 124 may move independently of the other support 124. It is thus possible to achieve a tilting of the web feeding arm 120 relative the web feeding frame 110. For this purpose the web feeding arm 120 is pivotally connected to the respective supports 124, as will be further described later.

Moreover, the supports 124 may also be provided with additional position control devices such that the cross-wise positioning of the web feeding arm 120 relative the web feeding frame 100 is adjustable, or controllable.

The automatic splicing device 100 further comprises a cutting unit 130. The cutting unit 130 has a cutting arm 132 and a sealing arm 134. The cutting arm 132 extends across the web feeding frame 110 so that the entire width of the material web may be cut by activating the cutting arm 132. In a similar manner the sealing arm 134 extends across the web feeding frame 110 so that the entire width of the material web may be sealed, or spliced, by activating the sealing arm 134.

The cutting arm 132 and the sealing arm 134 extend across the web feeding frame 110 in a tilted manner, such that the tilt angle β corresponds to the desired cut angle, i.e. the staggering angle a of the material web (see FIG. 2). Preferably, the tilt angle β is set automatically, which also means that the tilt angle β is adjustable depending on the current staggering angle a of the material web. The control unit 190 is thus preferably configured to determine the staggering angle α for example by receiving such input from an operator, and to set the tilt angle β accordingly.

In the shown example the cutting arm 132 and the sealing arm 134 form a respective side of a rectangular frame structure 136. The entire frame structure 136 is tilted, which means that the cutting arm 132 and the sealing arm 134 always remain at the same position relative each other.

The cutting arm 132 and the sealing arm 134 are arranged at a fixed position relative a detector, preferably in the form of an imaging device 140. The imaging device 140 is preferably arranged onto a planar support surface 142 such that the material web can be kept planar by the support surface 142 when the imaging device 140 is activated to record images of the material web. In other embodiments the detector may e.g. be a magnetic reader configured to detect the presence and position of magnetic marks.

The automatic splicing device 100 also has a rear web handling unit 150. The rear web handling unit 150 is configured to move an end of the material web in the longitudinal direction, and for this purpose the rear web handling unit 150 is provided with means 152 for securing the material web to the rear web handling unit 150.

Similarly to the web feeding arm 120 the securing means 152 of the rear web handling unit 150 may e.g. include vacuum suction nozzles distributed along the cross-wise extension of the rear web handling unit 150, adhesives, or similar. Preferably the securing means 152 is controllable such that securing of the material web could be activated and deactivated, respectively.

The rear web handling unit 150 is longitudinally movable along a rear web handling frame 160 having two parallel beams 162*a*, 162*b* guiding the two opposite lateral ends of the rear web handling unit 150. It should be noted that the rear web handling unit 140 may be replaced by other equipment having the same capabilities of moving the material web in a controlled manner. Hence, the rear web handling unit 150 may be a part of downstream equipment rather than forming part of the automatic splicing device 100.

There is a certain longitudinal overlap between the web feeding frame 110 and the rear web handling frame 160 such that the web feeding arm 120 and the rear web handling unit 150 can be positioned at the same longitudinal position.

Drive units (not shown) may be provided for moving the rear web handling unit 150 along the rear web handling frame 160. It should be noted that the rear web handling unit 150 is arranged perpendicularly to the longitudinal extension of the rear web handling frame 160.

Optionally, a rear imaging device 170 is provided at the area of the rear web handling unit 160. The rear imaging device 170 is preferably arranged onto a planar support surface 172 such that the material web can be kept planar by the support surface 172 when the imaging device 170 is activated to record images of the material web. For the embodiments utilizing a rear imaging device 170, such rear imaging device 170 may be configured to verify the correct position of the material web.

The imaging devices 140, 170 are preferably arranged to monitor distinguishable areas in the main body of the packaging material web. "Distinguishable areas" may correspond to a register mark or merely a particular area of the decor as has been described above. There are many kinds of imaging devices commercially available and for simplicity they will be referred to as "cameras" in the following. Any type of digital or analogue imaging devices suitable for the purpose may be used.

A control unit 190 is also provided for controlling the operation of the automatic splicing device 100. Although the general principles of operation will be described with reference to FIGS. 5-14, some general comments on the functionality of the control unit 190 will be given.

The control unit 190 receives input from the detector, such as the imaging device(s) 140, 170 comprising information relating to the position of a mark of the material web. The received information may e.g. be a captured image, whereby the control unit 190 is configured to perform image analysis in order to retrieve the exact position of the mark. In an alternative embodiment the image device 140, 170 is by itself implementing dedicated software in order to retrieve the exact position of the mark, whereby the control unit 190 receives the determined coordinates for the specific mark.

The control unit 190 is further configured to control movement of the material web based on the input received from the image device(s) 140, 170. Control is performed by communication links (indicated by the arrows in FIG. 4) between the control unit 190 and specific parts of the automatic splicing device 100. As is indicated in FIG. 4 the control unit 190 is configured to control the movement of the web feeding arm 120 by sending out control signals to the drivers of the supports 124. Further, the control unit 190 is also configured to control activation and deactivation of the holding means 122 of the web feeding arm 120.

The control unit 190 is also configured to control activation of the holding means 133 of the cutting arm 132, as well as activation of the cutting arm 132 itself in order to perform cutting of the material web 10. In a similar manner the control unit 190 is configured to transmit control signals to the sealing arm 134 and its associated holding means 135.

The control unit 190 is also configured to control movement of the rear web handling unit 150, and the activation and deactivation of the holding means 152 of the rear web handling unit 150.

The communication links between the control unit 190 and the various parts of the automatic splicing device 100 are preferably bi-directional, such that the control unit 190 also receives input signals relating to the current status and position of the web feeding arm 120, the cutting unit 130, and the rear web handling unit 150.

The control unit 190 is configured to control movement of the various parts of the automatic splicing device 100 based on the determined position of the mark and based on a reference coordinate system. Each movement is controlled based on this reference coordinate system such that exact positioning of the web feeding arm 120 and the rear web handling unit 150 is possible.

Now turning to FIGS. 5-14 operation of the automatic splicing device 100 will be described.

Figure 5:
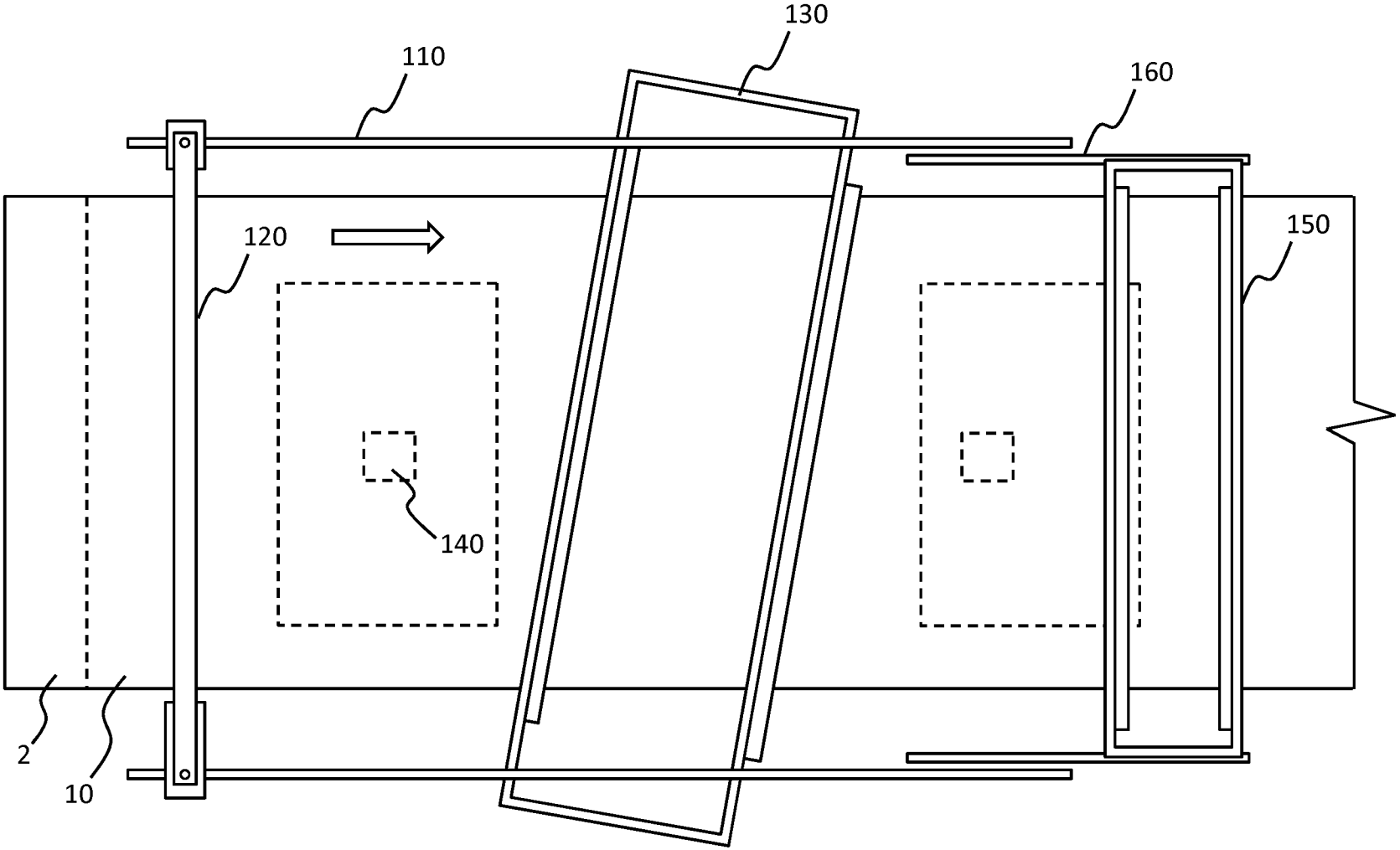
FIGS. 5-14 are top views of the automatic splicing device shown in FIG. 4 during operation.

In FIG. 5 an idle state is shown, in which a web of material 10 is continuously fed through the automatic splicing device 100 from a supply roll 2. The cutting unit 130 is arranged at a fixed position, wherein the longitudinal position is fixed at a predetermined and well-defined distance from the detector, such as the imaging device 140. The tilt angle is set and fixed according to the staggering angle of the material web, as described above. Further, in this idle state the web feeding arm 120 is positioned at the front end of the web feeding frame 110, while the rear web handling unit 150 is positioned at a rear end of the rear web handling frame 160. In the idle state shown in FIG. 5 there is no engagement of the material web 10 by means of the automatic splicing device.

Figure 6:
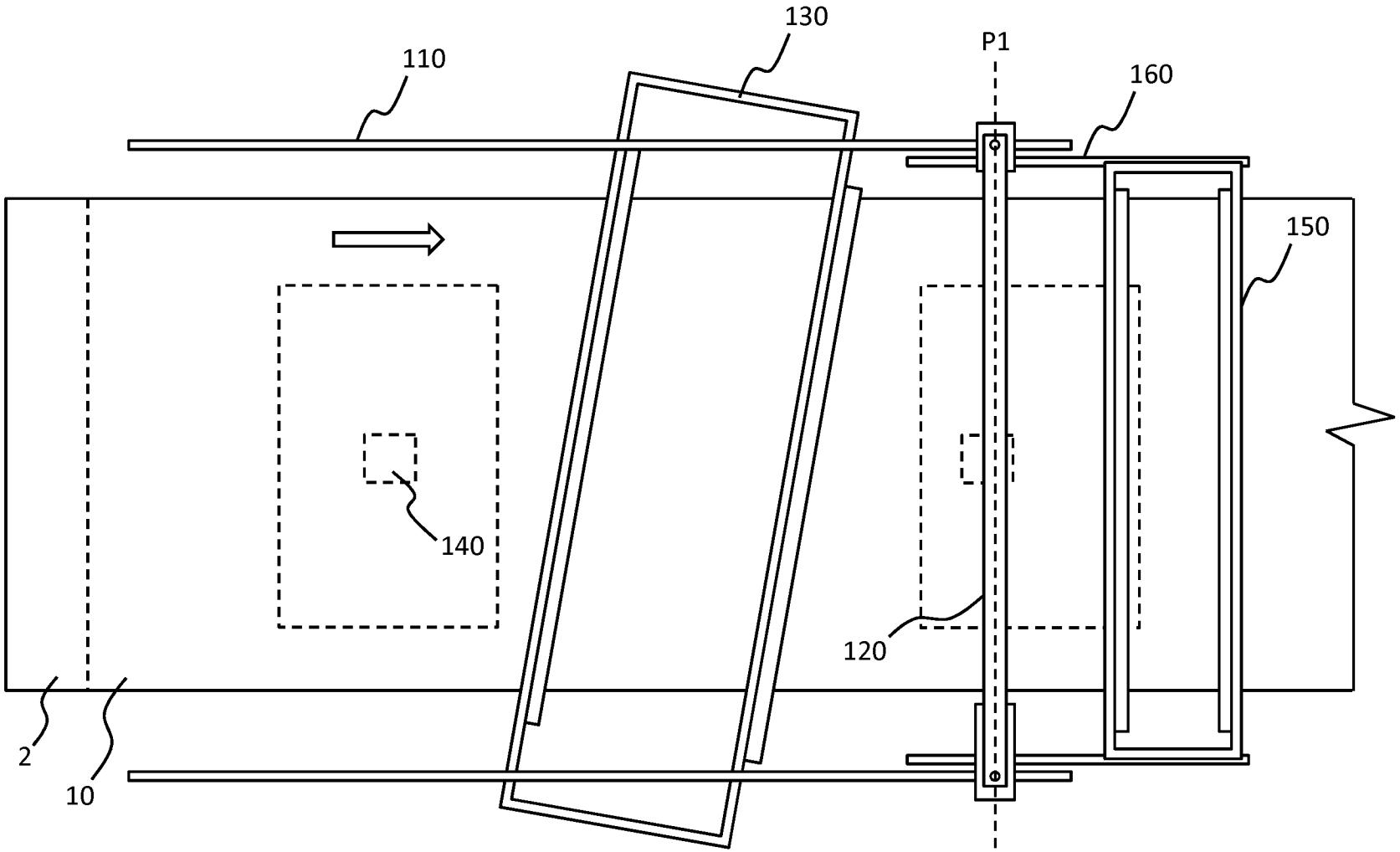

Now turning to FIG. 6, when it is decided to perform splicing unwinding of the material web 10 is stopped. The web feeding arm 120 then engages with the material web 10 by activating the securing means 122 and moves longitudinally in the forward direction to a predefined end position P1. The material web 10 is secured to the web feeding arm 120 during this movement such that the material web 10 is fed accordingly. At this position P1 holding means, such as a vacuum holder 180 arranged in the support surface 172 of the rear imaging device 170 (see FIG. 4), secures the position of the material web 10.

Figure 7:
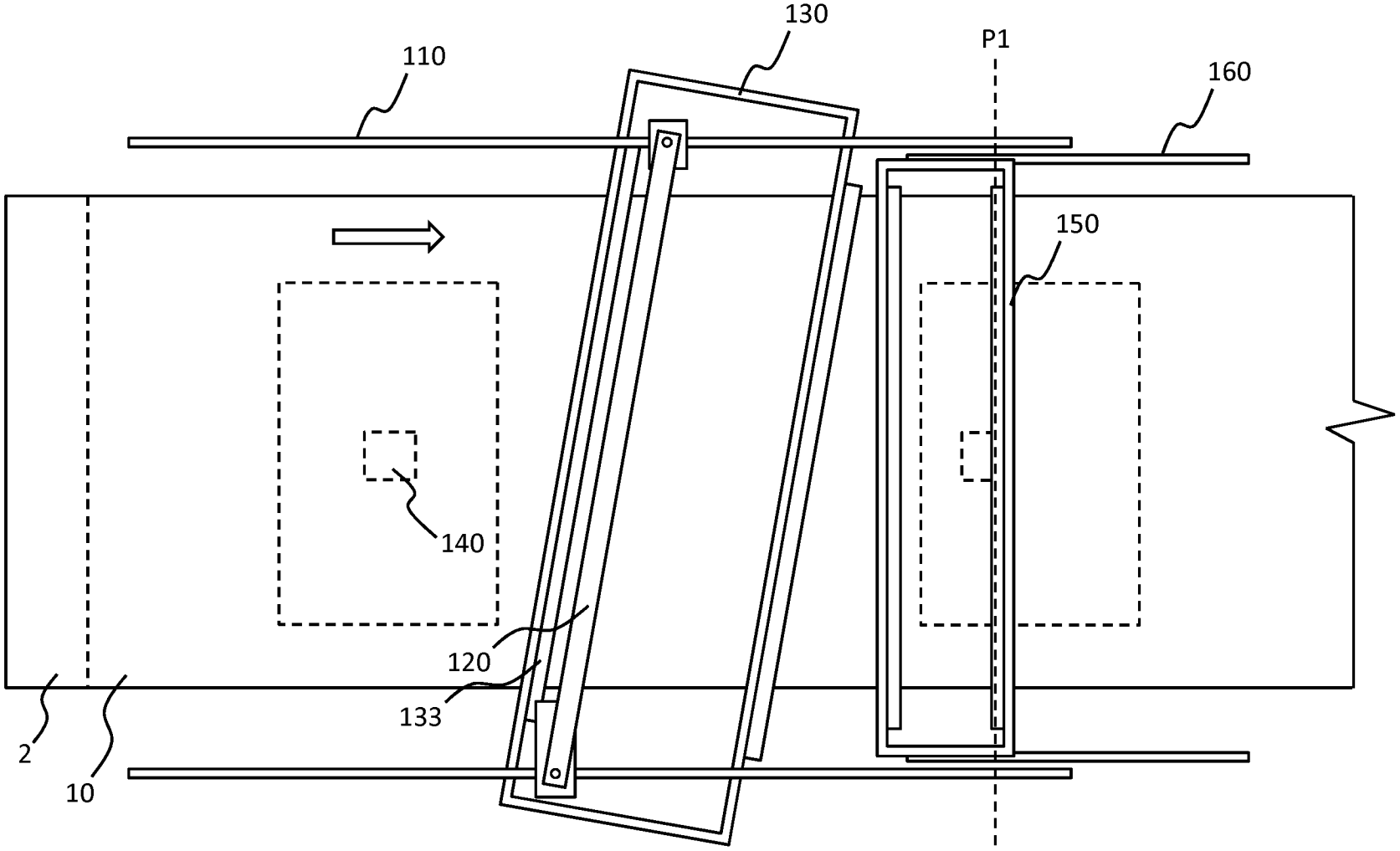
Figure 8:
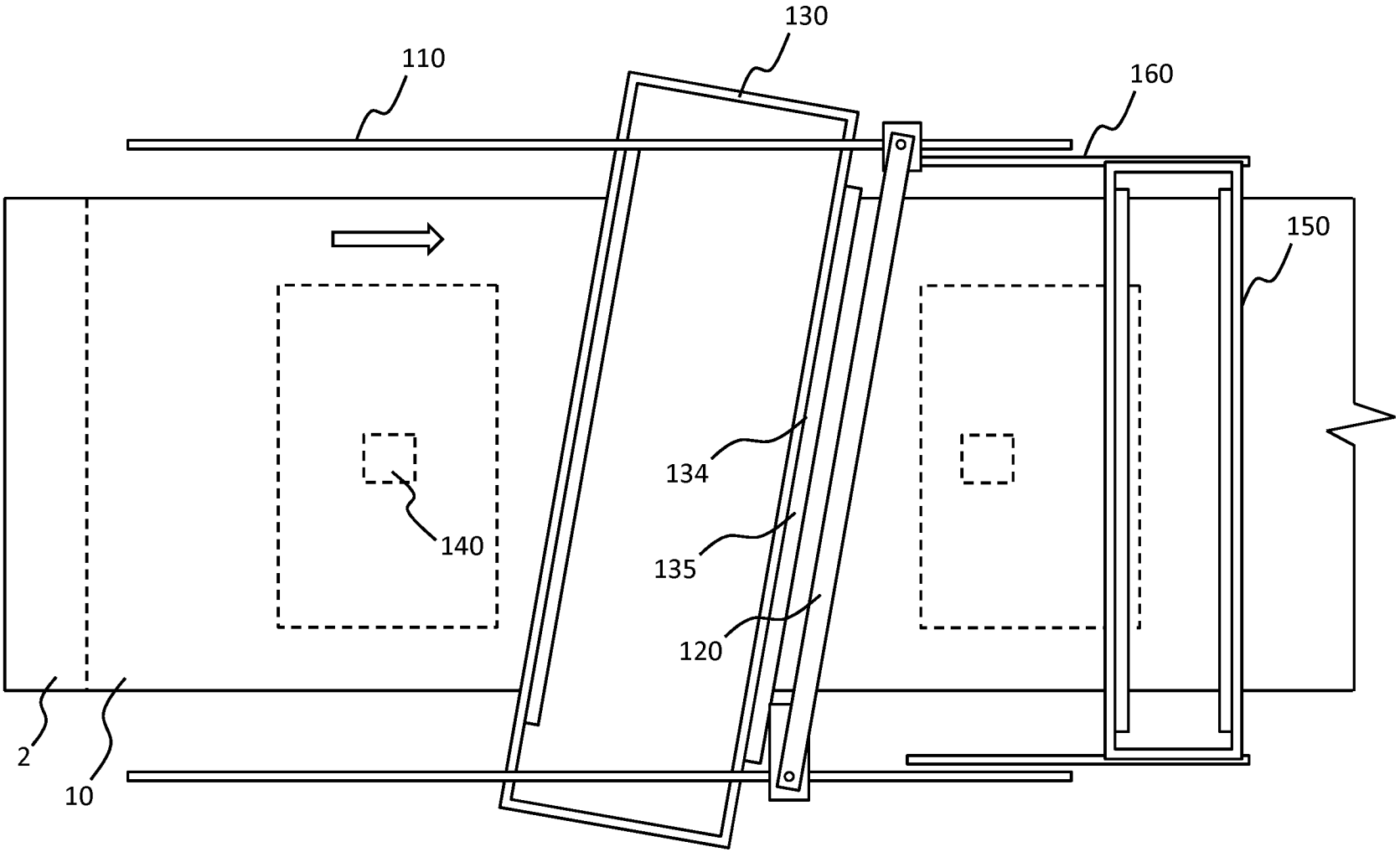

When the longitudinal position of the material web 10 is fixed the web feeding arm 120 will move backwards and at the same time adjust to the tilting angle of the cutting unit 130, which tilting angle is set in accordance with the staggering angle a of the material web. This is shown in FIG. 7. Tilting of the web feeding arm 120 is accomplished by controlling the support drivers independently. At the same time as the web feeding arm 120 moves backwards the rear web handling unit 150 moves backwards, i.e. longitudinally towards the cutting unit 130, until it reaches the predefined end position P1. The position of the cutting unit 130 remains constant.

For the embodiments utilizing an imaging device, in this position the imaging device 140 is activated to capture at least one image of the web material 10. The imaging device 140 thus forms part of a vision system configured to detect the x- and y-coordinates (i.e. the longitudinal and cross-wise position) of any mark provided onto the material web 10. The mark may e.g. be a register mark, an embedded magnetic mark, or similar. The exact position of the mark, i.e. the detected x- and y-coordinates, are transmitted to the control unit 190 (see FIG. 4) which also is configured to control the operation of the various parts of the automatic splicing device 100. Such controllable parts may e.g. include the web feeding arm drivers, the rear web handling unit drivers, the holding means 180, the securing means 122, 132, the cutting arm 132, and the sealing arm 134.

Based on the received coordinates of the mark the control unit 190 controls the material web 10 is moved in a longitudinal forward direction by the rear web handling unit 150. This movement is controlled such that a suitable area of the material web 10, relative the position of the mark, is located in the proximity of the cutting arm 132. The exact movement of the rear web handling unit 150 is calculated based on the size of the packages to be formed by the material web 10, the staggering angle of the material web, and in order to minimize waste.

When the material web 10 is moved to the correct position the material web 10 is locked in place and cut, preferably in an acute angle. Locking may e.g. be achieved by activating holding means 133 of the cutting arm 132.

The cut may be performed in an angle in relation to a thickness direction of the web, such as about 10-30°, e.g. about 20°. The latter approach will generate an undercut surface by means of which the risk of a raw edge of fibrous material being exposed in a sealing area is reduced. This particular feature is disclosed in the previously cited EP1184311, and will not be described further herein.

After activation of the cutting arm 132, leaving the material web 10 in two separated parts, the leading part of the material web 10 is moved longitudinally forward by a synchronized movement between the web feeding arm 120 and the rear web handling unit 150. As mentioned earlier, the rear web handling unit 150 may be replaced by other equivalent equipment. This movement is stopped when the trailing end of the leading part of the material web 10 is located in the proximity of the sealing arm 134. Here, securing means 135 of the sealing arm 134 is activated to lock the position of the leading part of the material web 10. The securing means 135 of the sealing arm 134 and the holding means 133 of the cutting arm 132 may e.g. be implemented by an array of vacuum nozzles distributed across the cross-wise extension of the respective arm 132, 134.

Figure 9:
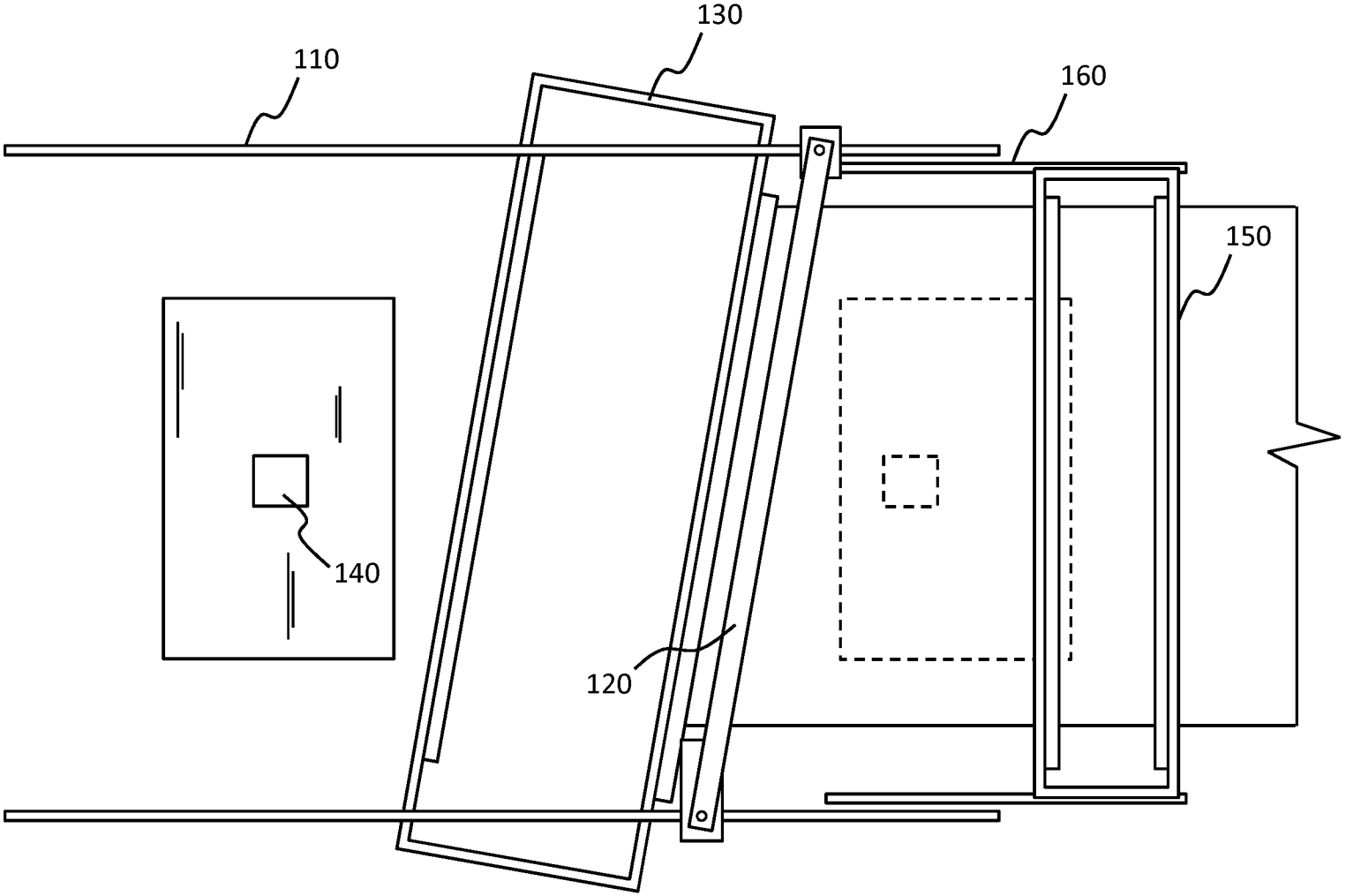

When the leading part of the material web 10 is locked in place at the sealing arm 134 the trailing part of the material web 10, including the supply roll 2, is removed from the automatic splicing device 100. This is shown in FIG. 9. However, should splicing be performed for doctoring the supply roll 2 may be left at the inlet side of the automatic splicing device 100.

Figure 10:
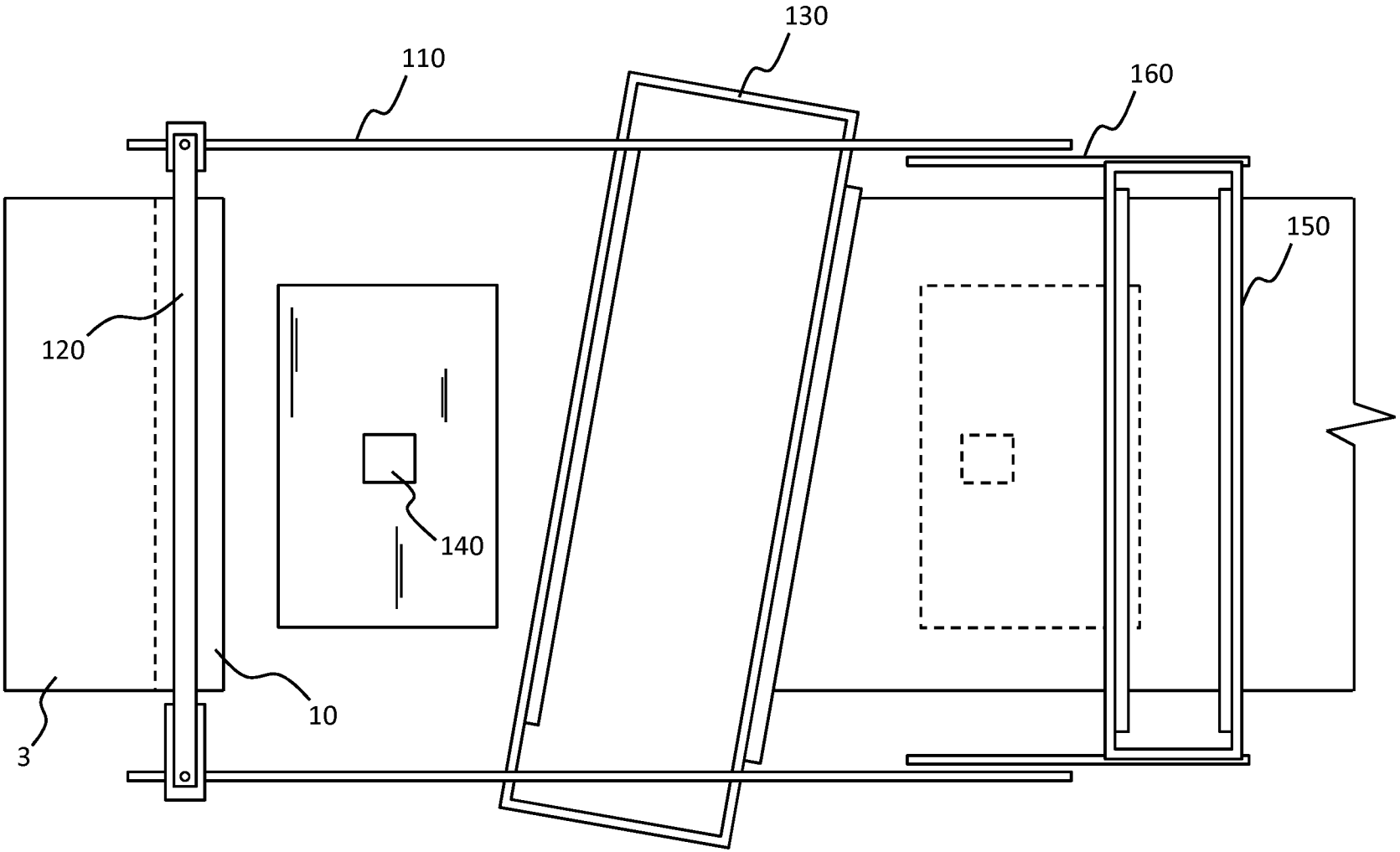
Figure 11:
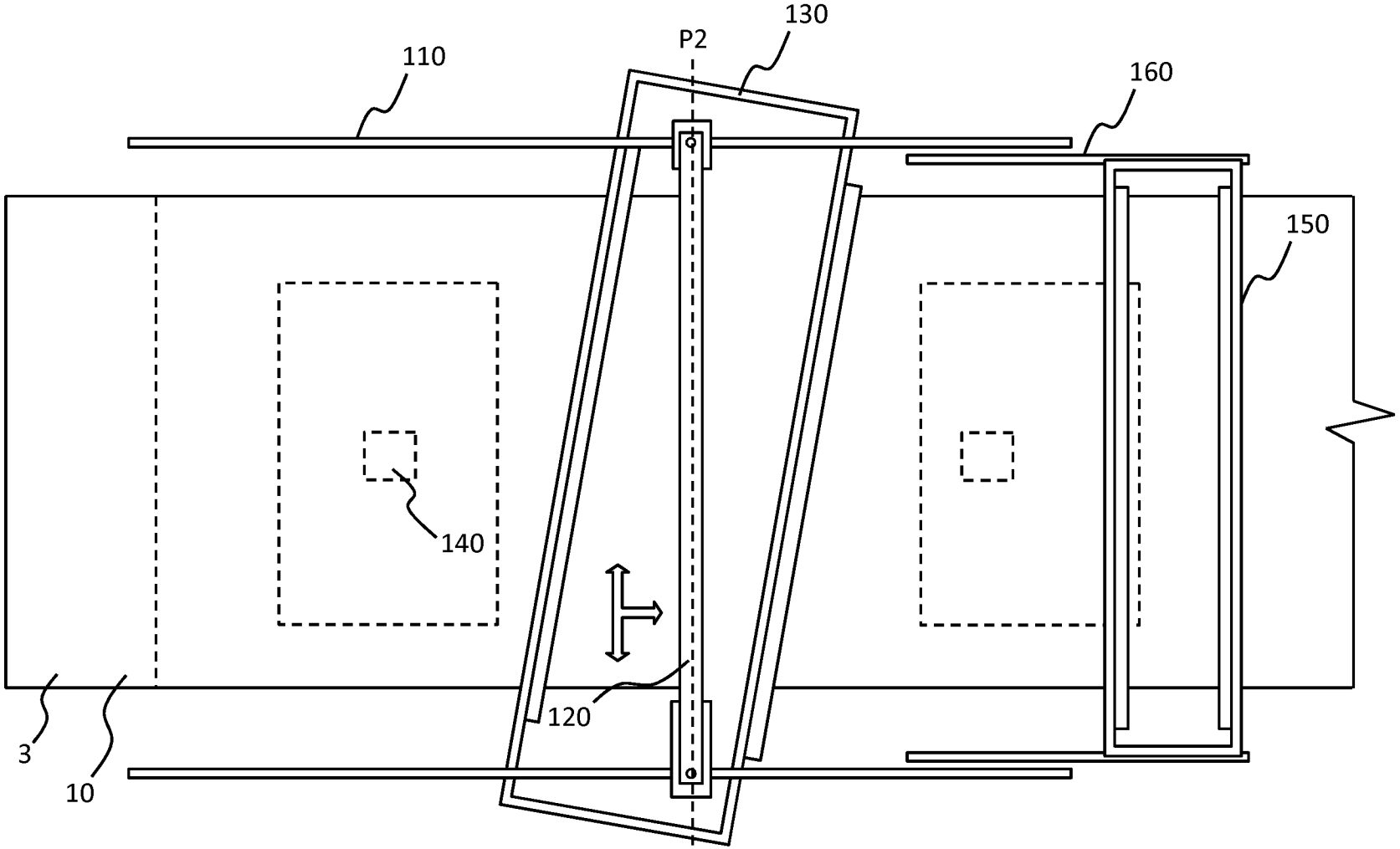

In FIG. 10 a new supply roll 3 has been loaded to the automatic splicing device 100. At the same time the web feeding arm 120 has been returned to its idle position at the front end of the web feeding frame 110. When arranged in this position the web feeding arm 120 engages with the new material web 10 and moves it longitudinally forward until it passes the cutting arm 132 of the cutting unit 130. The motion of the web feeding arm 120 is stopped when a predefined longitudinal position P2 is reached. This is shown in FIG. 11.

When the web feeding arm 120 has reached the position P2 the imaging device 140 is activated to capture at least one image of a mark of the new material web 10. By means of suitable image analysis the exact x- and y-coordinates of the mark is determined, and transmitted to the control unit 190 for further control of the automatic splicing device 100. Such further control includes correcting the position of the new material web 10 such that a specific section of the material web 10 is positioned in the proximity of the cutting arm 132. The exact position is determined based on the newly detected x- and y-coordinates of the mark, but also based on the previously detected x- and y-coordinates for the "old" material web 10, now locked at the sealing arm 134.

Positioning of the new material web 10 is accomplished by a longitudinal as well as cross-wise adjustment of the material web 10. Position adjustment is performed by controlling the web feeding arm 120 in both longitudinal and cross-wise direction e.g. by means of the drivers or drive units described above.

Figure 12:
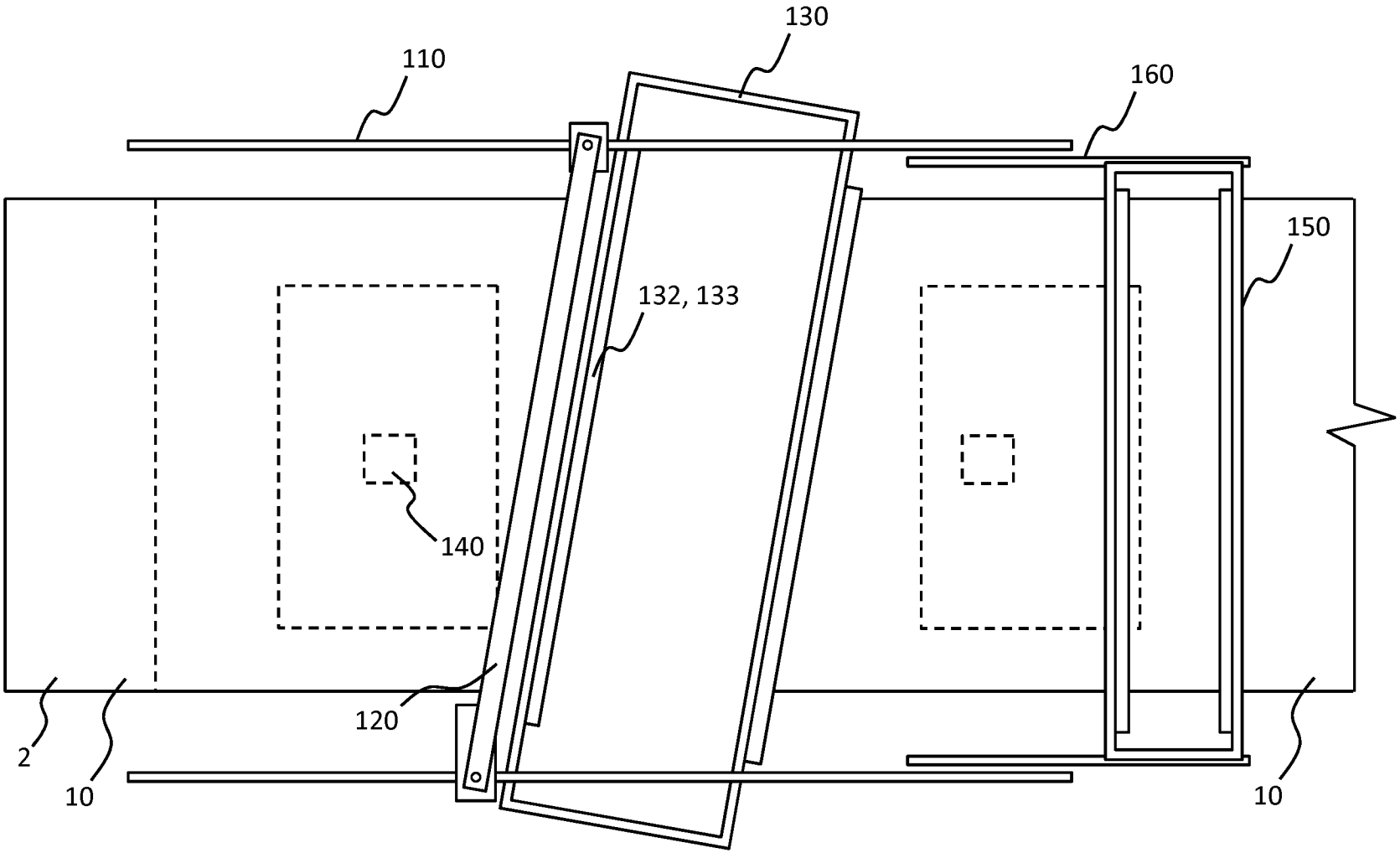

As soon as the correct positioning is achieved the material web 10 is locked in position by means of the cutting arm 132 (or rather the holding means 133 of the cutting arm 132) and the cut is thereafter performed to form a separate trapezium part of material web 10. This is shown in FIG. 12, however in the figure the trapezium part has been removed by means of a waste hatch provided in between the cutting arm 132 and the sealing arm 134. The web feeding arm 120 thereafter moves longitudinally backwards to a tilted position immediately in front of the cutting arm 132. Here the web feeding arm 132 engages with the material web 10 while the material web 10 is released from the holding means 133 of the cutting arm 132.

Figure 13:
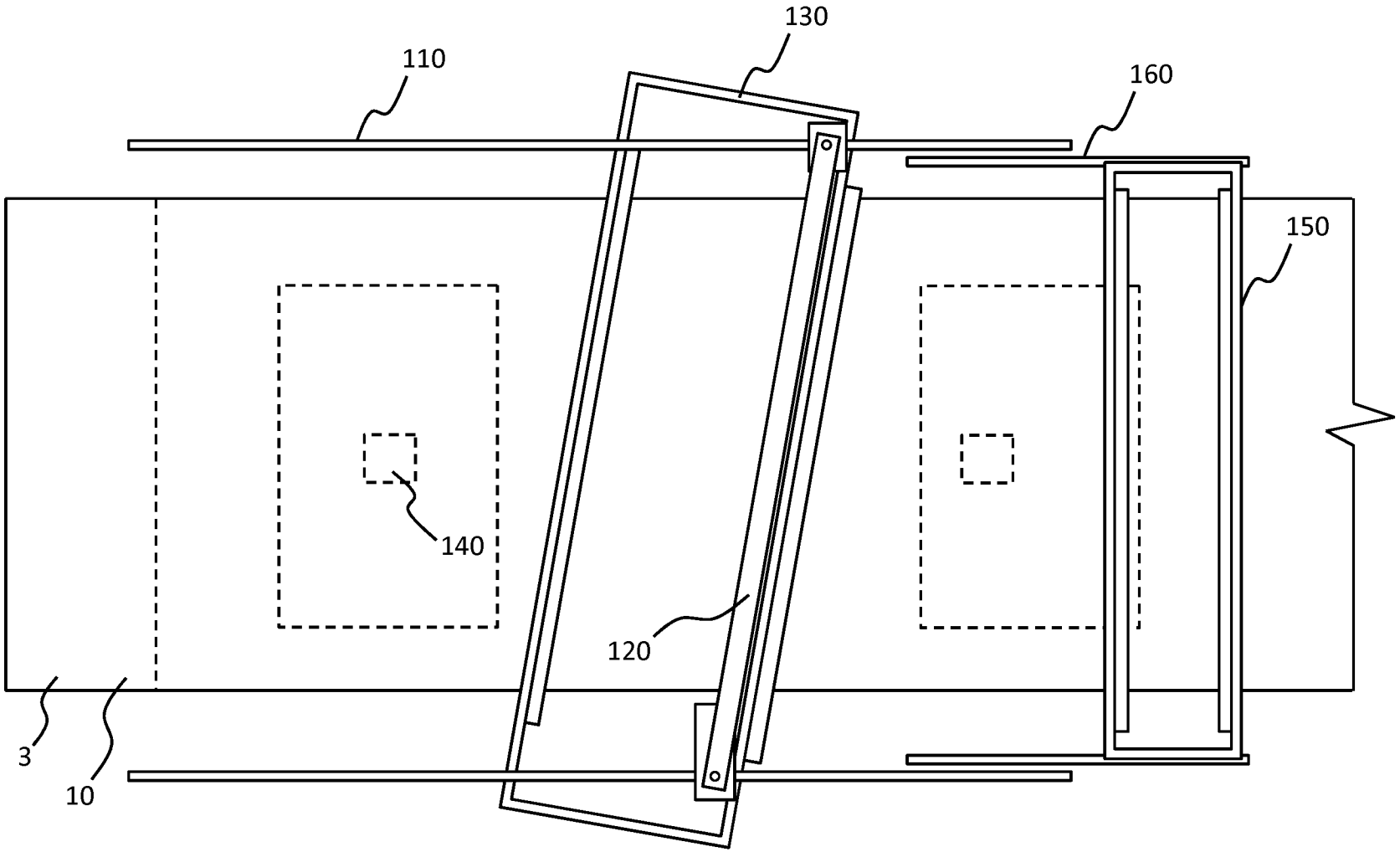

In a final operation step, illustrated in FIG. 13, the web feeding arm 120 moves longitudinally forward towards the sealing arm 134. The incoming material web 10 is fed forward until it overlaps the "old" material web 10 to some extent. At this position the leading end of the new material web 10 is locked in position by means of the securing means 135 of the sealing arm 134, and thereafter sealing can be performed. The sealing operation is performed by exposing the overlapping area of the material webs 10 to a certain amount of energy and pressure for a predetermined time period.

Figure 14:
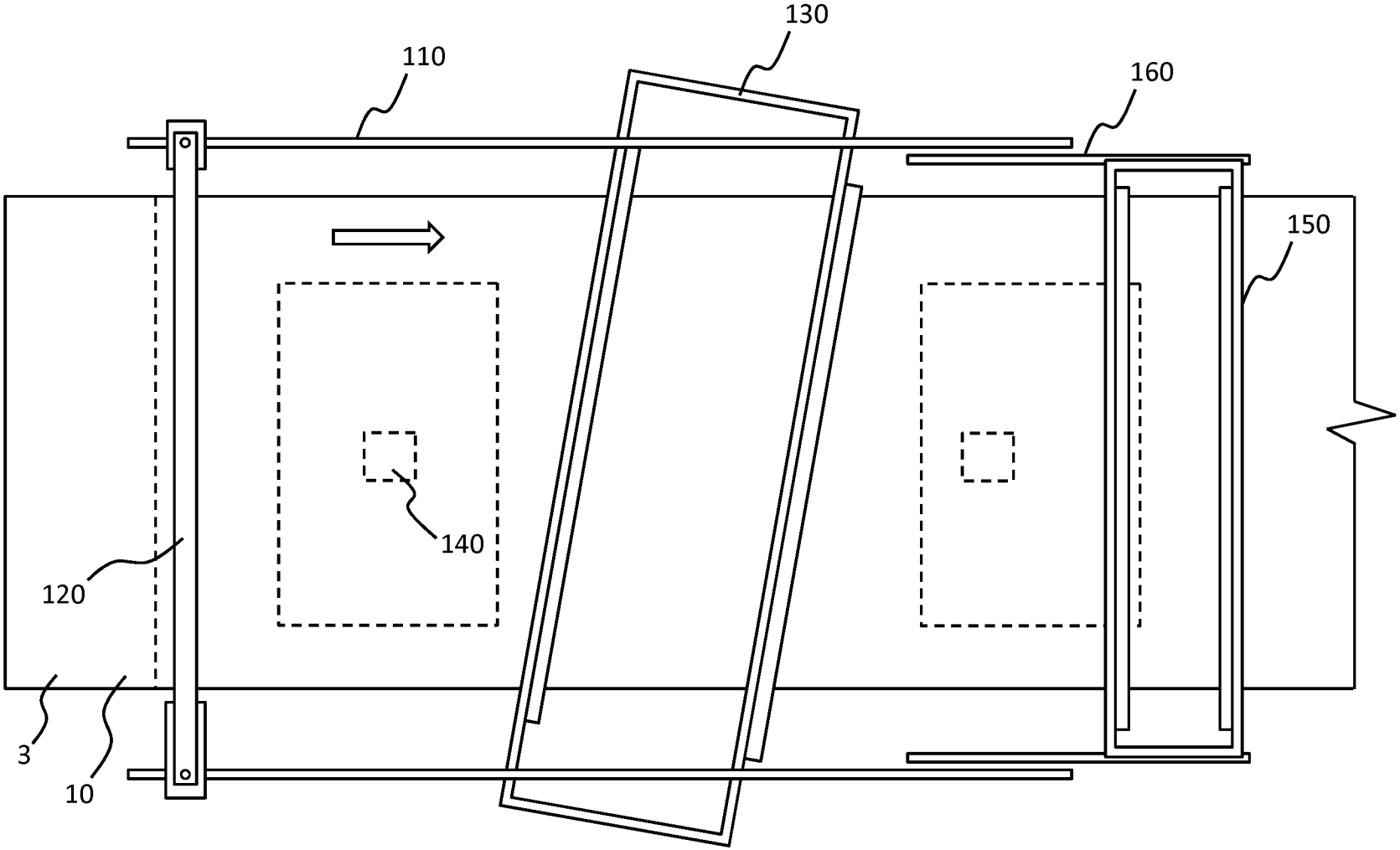

After the sealing is finished the two material webs 10 are joined and further operation of upstream and downstream equipment can be restarted. The web feeding arm 120 is then returned to its idle position, as illustrated in FIG. 14.

The splice has shown geometrical tolerances of ±0.5 mm both in longitudinal and cross-wise direction.

In view of above the automatic splicing device 100 is capable of splicing two ends of material webs by the novel use of a detector, such as an imaging device, configured to determine the position of marks present on the original material web as well as on the new material web. The two material web ends are moved to their respective cutting position, which position is based on the determined position for the respective marks.

The invention claimed is:

1. A method for splicing a web of packaging material, comprising:

guiding a first web of packaging material through an automatic splicing device, the first web of packaging material comprising at least one mark, the automatic splicing device comprising a web feeding arm configured to move the first web of packaging material and a second web of packaging material;

determining the position of the at least one mark of the first web of packaging material by a detector;

moving the first web of packaging material via the web feeding arm based on the position of the at least one mark of the first web of packaging material such that a specific area of the first web of packaging material is arranged in proximity to a cutting unit;

cutting the first web of packaging material in order to form a separate leading part of the first web of packaging material;

introducing a new leading part of the second web of packaging material into the automatic splicing device, the second web of packaging material comprising at least one mark;

determining the position of the at least one mark of the second web of packaging material;

moving the second web of packaging material via the web feeding arm based on the position of the at least one mark of the second web of packaging material such that a specific area of the second web of packaging material is arranged in proximity to a sealing arm of the cutting unit; and sealing the separate leading part of the first web of packaging material and the second web of packaging material.

2. The method of claim 1, wherein determining the position of the at least one mark of the first and second web of packaging material is performed using a detector in the form of an imaging device and associated image analysis.

3. The method of claim 1, further comprising cutting the second web of packaging material prior to moving the second web of packaging material based on the position of the at least one mark of the second web of packaging material such that the specific area of the second web of packaging material is arranged in proximity to the sealing arm of the cutting unit.

4. The method of claim 1, wherein the position of the cutting unit is fixed during the entire splicing operation.

5. The method of claim 1, wherein cutting the first web of packaging material and cutting the second web of packaging material is performed at an angle relative to the cross-wise direction of the first web of packaging material.

6. The method of claim 1, further comprising moving the separate leading part of the first web of packaging material longitudinally to a sealing position prior to introducing the new leading part of the second web of packaging material into the automatic splicing device.

7. An automatic splicing device for web material comprising a cutting unit configured to cut and seal a first web material comprising at least one mark, a web feeding arm configured to move the first web material, at least one detector and a control unit wherein said control unit is configured to:

determine the position of the at least one mark of the first web material, control the web feeding arm based on the position of the at least one mark of the first web material such that a specific area of the first web material is arranged in proximity to the cutting unit, determine the position of at least one mark of a second web material, control the web feeding arm based on the position of the at least one mark of the second web material such that a specific area of the second web material is arranged in proximity to the cutting unit, and control sealing of the first web material to the second web material.

8. The automatic splicing unit according to claim 7, wherein said web feeding arm extends across the width of the first web material.

9. The automatic splicing unit according to claim 7, wherein said web feeding arm is configured to be tilted relative to a longitudinal direction of the first web material or second web material.

10. The automatic splicing unit according to claim 7, wherein the cutting unit comprises a cutting arm and a sealing arm.

11. The automatic splicing unit according to claim 10, wherein the cutting arm and the sealing arm are mounted on a fixed frame.

12. The automatic splicing unit (100) according to claim 10, wherein the cutting arm and the sealing arm are tiltable relative to a longitudinal direction of the first web material or second web material.

13. The automatic splicing unit according to claim 10, wherein said cutting arm and said sealing arm extend across the width of the first web material.

14. The automatic splicing unit according to claim 10, wherein the cutting arm is arranged at a longitudinal distance from said sealing arm.

* * * * *